US010407800B2

(12) United States Patent
Meise

(10) Patent No.: US 10,407,800 B2
(45) Date of Patent: Sep. 10, 2019

(54) METHOD AND DEVICE FOR PRODUCING A MULTIFILAMENT THREAD FROM A POLYAMIDE MELT

(71) Applicant: OERLIKON TEXTILE GMBH & CO. KG, Remscheid (DE)

(72) Inventor: Hansjörg Meise, Leichlingen (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 222 days.

(21) Appl. No.: 15/519,219

(22) PCT Filed: Oct. 7, 2015

(86) PCT No.: PCT/EP2015/073092
§ 371 (c)(1),
(2) Date: Apr. 14, 2017

(87) PCT Pub. No.: WO2016/058873
PCT Pub. Date: Apr. 21, 2016

(65) Prior Publication Data

US 2017/0233895 A1 Aug. 17, 2017

(30) Foreign Application Priority Data

Oct. 18, 2014 (DE) ..... 10 2014 015 454

(51) Int. Cl.
*D01D 5/16* (2006.01)
*D01D 13/02* (2006.01)
(Continued)

(52) U.S. Cl.
CPC ..... *D01D 5/16* (2013.01); *D01D 10/02* (2013.01); *D01D 13/02* (2013.01); *D01F 6/60* (2013.01)

(58) Field of Classification Search
CPC ..... D01D 5/16; D01D 10/02; D01D 13/02; D01F 6/60
See application file for complete search history.

(56) References Cited

U.S. PATENT DOCUMENTS 4,731,217 A * 3/1988 Gerhartz ..... D01D 10/02 242/477.6
4,731,218 A * 3/1988 Damhorst ..... D01D 5/16 264/129

(Continued)

FOREIGN PATENT DOCUMENTS

| | | | |
|---|---|---|---|
| CN | 202247054 | U | 5/2012 |
| DE | 3146054 | A1 | 8/1982 |
| EP | 2395136 | A1 | 12/2011 |

*Primary Examiner* — Nahida Sultana
(74) *Attorney, Agent, or Firm* — BainwoodHuang

(57) ABSTRACT

Techniques produce a multifilament thread from a polyamide melt. In this case, freshly extruded filaments are cooled and combined to form a thread. In order, in addition to low boil-off shrinkage, to achieve high strength, the thread is taken off at a take-off rate in the range from 3600 m/min to 4600 m/min, preferably from 4000 m/min to 4400 m/min, by a first godet group having unheated guide casings. Subsequently, the thread is fully drawn between the first godet group and a second godet group having heated guide casings. After drawing, the thread is heated to a thread temperature in the range from 140° C. to 200° C. under tension at the guide casings of the second godet group and relaxed. After relaxing, the thread runs in a contact-free manner through at least one free cooling section between the second godet group and a third godet group having unheated guide casings.

16 Claims, 3 Drawing Sheets

Figure 1:
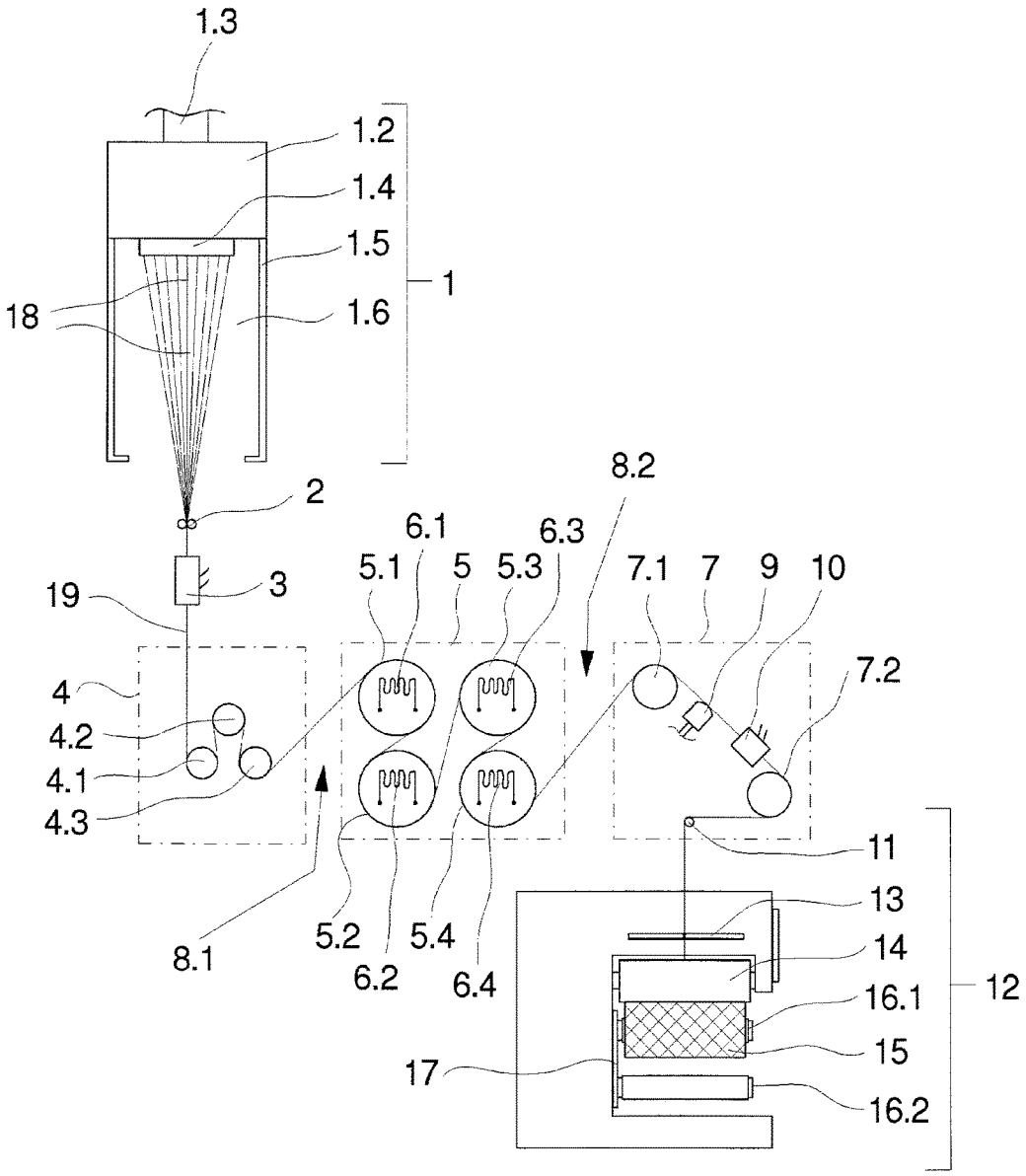

(51) Int. Cl.
*D01D 10/02* (2006.01)
*D01F 6/60* (2006.01)

(56) References Cited

U.S. PATENT DOCUMENTS

| | | | | | |
|---|---|---|---|---|---|
| 5,558,825 | A * | 9/1996 | Ueda | D01D 5/16 | 264/103 |
| 5,558,826 | A | 9/1996 | Jaegge et al. | | |
| 6,120,715 | A * | 9/2000 | Weigend | D01D 5/16 | 264/103 |
| 2005/0151295 | A1* | 7/2005 | Schemken | D02G 1/0266 | 264/168 |
| 2009/0146338 | A1* | 6/2009 | Chuah | D01D 5/16 | 264/177.17 |
| 2013/0052293 | A1* | 2/2013 | Weinhold | B26D 1/285 | 425/336 |
| 2014/0163124 | A1* | 6/2014 | Kurashina | B01D 67/0009 | 521/92 |
| 2016/0279897 | A1* | 9/2016 | Yamazaki | B32B 5/26 | |
| 2017/0050346 | A1* | 2/2017 | Turkaslan | B65H 63/065 | |
| 2017/0311651 | A1* | 11/2017 | Yoshioka | A41B 11/00 | |

* cited by examiner

METHOD AND DEVICE FOR PRODUCING A MULTIFILAMENT THREAD FROM A POLYAMIDE MELT

The invention relates to a method for producing a multifilament yarn from a polyamide melt as disclosed herein, as well as to a device for carrying out the method and as disclosed herein.

The production of multifilament yarns from a melt is generally performed by the melt-spinning method. Herein, a previously generated melt from a polymer is supplied at pressure to a spinning nozzle which extrudes finest filament strands from a multiplicity of nozzle openings. The extruded filaments after cooling and solidifying of the melt are assembled to form the yarn and drawn off. The yarn is subsequently drawn and relaxed in order to obtain the desired physical properties. The individual method steps have a significant influence on the yarn parameters such as, for example, a uniformity of mass or a quality of dyeability, as well as particularly on the textile properties such as strength, elongation, and boil water shrinkage. To this extent, the individual treatment steps such as cooling, drafting, and relaxing have to be mutually adapted in order to obtain the properties desired for the yarn type. The polymer material from which the filaments have been extruded is to be taken into account here. For example, polyester and polyamide have different melting temperatures, this influencing in particular the treatment temperatures when drafting or relaxing.

The production of a yarn from polyester, or the production of a yarn from polyamide, therefore requires fundamentally different adjustment parameters, such as can be derived from DE 35 08 955 A1, for example.

It is thus known that the drawing-off speed of a yarn from a spinning zone in the production of a yarn from polyamide is adjusted substantially higher as compared to the production of a yarn from polyester. Drafting herein is performed between two groups of multiple godets, the latter having in part heated guide casings. Thermal post-treatment for relaxing is performed in particular by the second group of godets having heated guide casings. It can be established herein that a reduction in the so-called boil water shrinkage is achieved at an increasing surface temperature of the guide casings. However, it is to be considered herein that excessive thermal stress in the post-treatment of the filaments leads to a loss of strength in the case of the polyamide.

It is therefore now an object of the invention to refine a method and a device for producing a multifilament yarn from a polyamide melt in such a manner that the yarn, despite relatively low boil water shrinkage values, has a high strength.

According to the invention, this object is achieved by a method having the features as disclosed herein, as well as by a device having the features as as disclosed herein.

Advantageous refinements of the invention are defined by the features and the combinations of features as disclosed herein.

The invention is based on the finding that, in addition to the thermal treatment, also yarn guidance represents a substantial influencing value in the configuration of the physical properties. It has thus been recognized that the location of a friction point after the relaxation treatment significantly influences the quality of the yarn formed from polyamide. The method according to the invention is thus based on three godet groups of multiple godets in total. A first godet group having non-heated guide casings draws the yarn from the spinning installation at a speed in the range from 3400 m/min to 4600 m/min, preferably from 4000 m/min to 4400 m/min. The yarn is subsequently drawn between the first godet group and a second godet group having heated guide casings. The guide casings of the second godet group are heated to a surface temperature in order to heat the yarn to a temperature in the range from 140° C. to 200° C., and to relax the yarn. The yarn thereafter is guided in a non-contacting manner in a free cooling section which is configured between the second godet group and a third godet group having non-heated guide casings. Stabilizing and sufficient setting of the yarn material is thus achieved. It is essential herein that no friction contact with the yarn prevails within the cooling section. It has thus been established that premature friction contact with the yarn within the cooling section leads to a significant loss in strength.

The method according to the invention is preferably embodied in that variant in the case of which the yarn on the guide casings of the first and second godet groups is guided in each case having a single wrapping in an angular range from 100° to 270°. The yarn in the case of thermal post-treatment can thus be heated in an alternating manner.

In order for the yarn to be drawn off, the first godet group has a total of three guide casings which, having increasing circumferential speeds, guide the yarn at a speed differential in the range from 20 to 100 m/min. A constant drawing-off speed and a constant drawing-off tension are thus guaranteed.

In order for the yarn to be relaxed, the yarn according to one advantageous refinement of the method according to the invention is preferably guided on a total of four guide casings having substantially identical circumferential speeds and identical surface temperatures. A tension that causes intensive contact of the yarn with the heated guide casings is thus maintained on the yarn.

In order for the residual internal stress to be released, the yarn according to one further variant of the method between a last guide casing of the second godet group and a first guide casing of the third godet group, having decreasing circumferential speeds, is guided at a speed differential in the range from 0 to 50 m/min. The cooling section can thus be simultaneously be used for residual release of stress.

For the case in which no comparatively large deflections are required on the yarn between the spinning installation and the first godet group, the yarns after cooling are preferably assembled to form the yarn in a dry state. An application of a preparation fluid that is required for further treatment is preferably performed on a sub-section between the guide casings of the third godet group. In principle, however, there is also the possibility of slightly wetting the filaments after cooling, such that static charge effects by intense deflections cannot negatively impact the filaments of the yarn.

After the preparation, the yarn is entangled in a sub-section between the guide casings of the third godet group such that a yarn-fit between the filaments of the yarn is establishable for further processing.

In order for the yarn to be wound to form a package, that variant of the method, in which the yarn is wound to form a package at a take-up winding speed that is lower than a circumferential speed of a last guide casing of the third godet group, has proven preferably successful. The additional yarn tension caused by the displacement of the yarn can thus be advantageously equalized.

The device according to the invention for carrying out the method is distinguished in that the treatment steps are adjustable in a mutually independent manner, without influencing neighboring treatments. The drawing-off speed and drawing-off of the yarn can thus be implemented solely by way of the drive controller of the guide casings of the first godet group. Drafting is performed between the first godet group and a second godet group having heated guide casings, such that the temperature control and the drafting speed are controllable solely by way of the second godet group. The further post-treatment steps are determined by the third godet group, after passing through the non-contacting cooling section, such that preparation and entanglement of the yarn are performed independently of the relaxation.

The guide casings of the first two godet groups are preferably configured so as to be drivable in a counter-rotating manner and are mutually disposed in such a manner that the yarn on the circumference of the guide casings is guidable in each case having a single wrapping in an angular range from 100° to 270°. In particular, the thermal treatments on the yarn can thus be performed by way of alternating wrappings. Moreover, very compact and short guide casings can be used in order for a plurality of yarns to be simultaneously treated.

Drawing-off the yarn from the spinning installation is preferably carried out by way of three non-heated guide casings which are assigned to the first godet group. Herein, at least two separate drives are provided in order for all guide casings of the first godet group to be driven.

The post-treatments that are performed after relaxing and prior to take-up winding are carried out by a preparation installation and an entanglement installation which according to advantageous refinements of the device according to the invention are preferably disposed in a yarn path between the guide casings of the third godet group.

The supply of the yarn to a take-up winding installation is performed according to one advantageous refinement of the device according to the invention in the case of which a last guide casing of the third godet group is assigned a deflection roller of the take-up winding installation. A transfer of the yarn to the winding position with low friction is thus possible.

The method according to the invention will be explained in more detail hereunder by means of a few exemplary embodiments of the device according to the invention, with reference to the appended figures.

Figure 2:
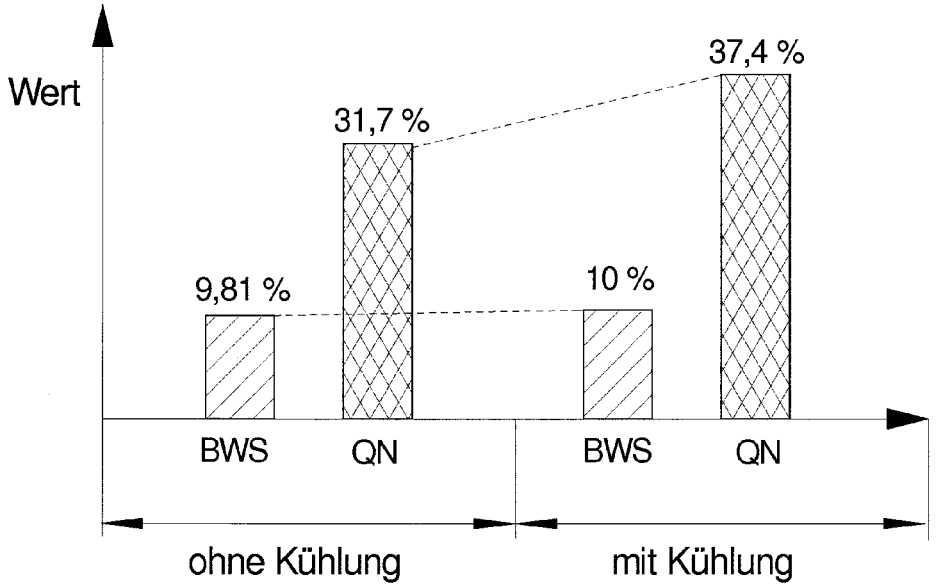
Figure 3:
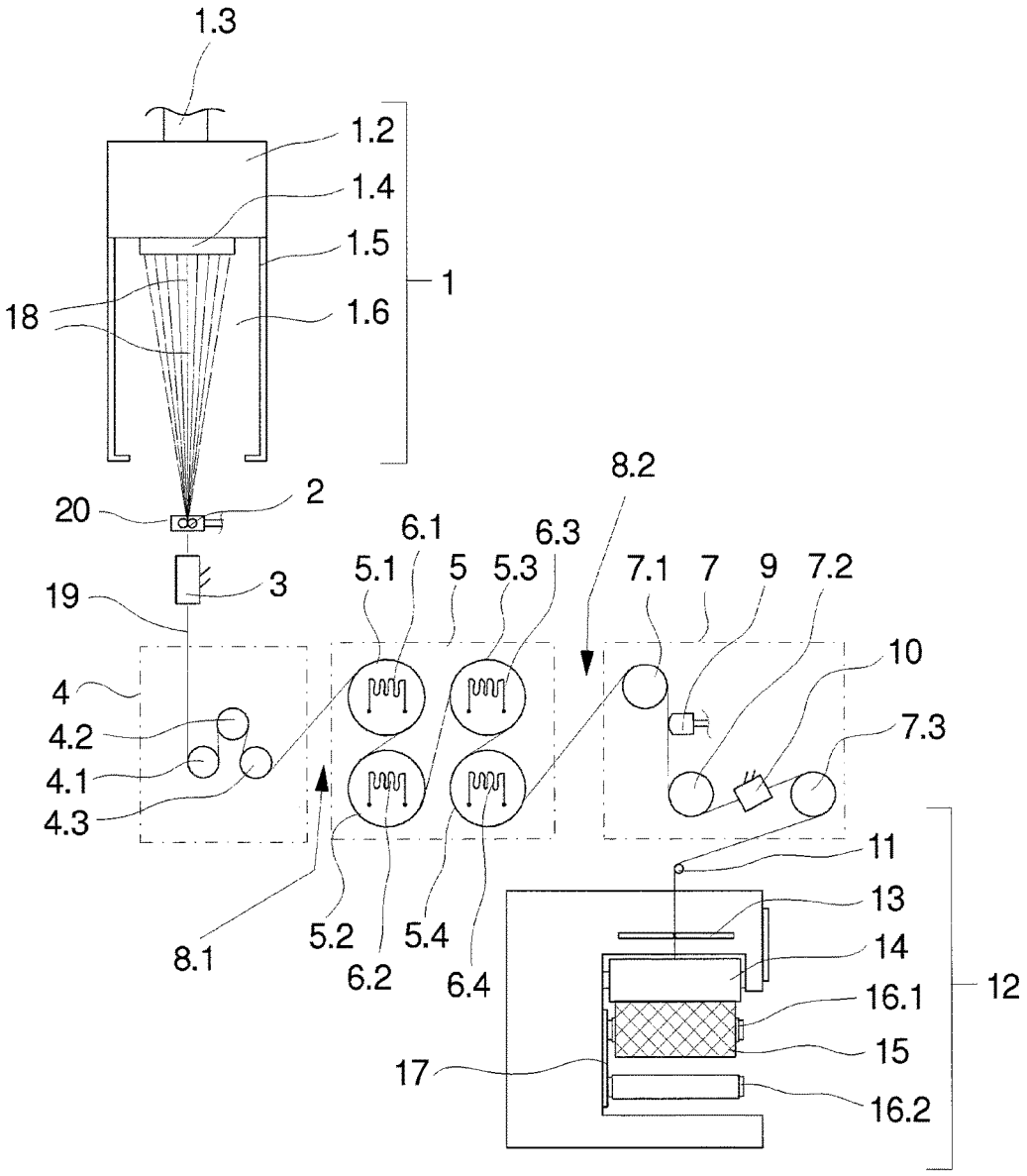

In the figures:

FIG. 1 schematically shows a first exemplary embodiment of the device according to the invention;

FIG. 2 schematically shows a diagram of physical properties of the yarn;

FIG. 3 schematically shows a further exemplary embodiment of the device according to the invention.

A view of a first exemplary embodiment of the device according to the invention for carrying out the method according to the invention is schematically shown in FIG. 1. The exemplary embodiment has a spinning installation 1 which is formed from a spinning beam 1.2 and a cooling device 1.5 that is disposed below the spinning beam 1.2. The spinning beam 1.2 on the lower side thereof has a spinning nozzle 1.4 which by way of a spinning pump (not illustrated in more detail here) is connected to a melt supply inlet 1.3. The cooling device 1.5 forms a cooling duct 1.6 below the spinning nozzle 1.4. Cooling air is blown into the cooling duct 1.6, wherein the cooling air is suppliable as so-called transverse-flow quenching or as radial outside-to-inside quenching.

An assembly yarn guide 2, which is disposed so as to be concentric with the spinning nozzle 1.4 and assembles a group of a plurality of filaments 18 that has been extruded from the spinning nozzles 1.4 to form a yarn 19, is provided below the spinning installation 1. The assembly yarn guide 2 is assigned an entanglement unit 3 in the yarn path.

For drawing off, drafting, and relaxing, the exemplary embodiment has a plurality of godet groups 4, 5, and 7. A first godet group 4 has a total of three non-heated guide casings 4.1, 4.2, and 4.3. The guide casings 4.1 to 4.3 are assigned a plurality of drives (not illustrated in more detail here), such that the guide casings 4.1 to 4.3 are drivable at predetermined circumferential speeds. The guide casings 4.1 to 4.3 are embodied so as to be drivable in a counter-rotating manner such that the yarn 19 is guidable with single wrappings on the circumference of the guide casings 4.1 to 4.3. A second godet group 5 which is formed from a total of four heated guide casings 5.1 to 5.4 is disposed downstream of the first godet group 4. Each guide casing 5.1 to 5.4 is heated by a separate heating means 6.1 to 6.4. To this end, the heating means 6.1 to 6.4 are embodied so as to be separately controllable. The guide casings 5.1 to 5.4 are likewise assigned drives (not illustrated here) which enable driving of the guide casings 5.1 to 5.4 in a counter-rotating manner.

A third godet group 7 which is formed from two non-heated guide casings 7.1 and 7.2 is disposed downstream of the second godet group 5. The guide casings 7.1 and 7.2 are embodied so as to be individually drivable. A preparation installation 9 and an entanglement installation 10 is disposed between the guide casings 7.1 and 7.2.

That yarn section that is formed between the first godet group 4 and the second godet group 5 is referred to as the drafting zone and is identified by the reference sign 8.1. The yarn section between the second godet group 5 and the third godet group 7 is referred to as the cooling section and is identified by the reference sign 8.2. No yarn-guidance elements are provided within the drafting zone 8.1 and within the cooling section 8.2, such that the yarn is guided in a non-contacting manner between the respective guide casings 4.3 and 5.1, and 5.4 and 7.1.

A take-up winding installation 12 which on a yarn run-in side has a deflection roller 11 is disposed below the third godet group 7. The deflection roller 11 in the yarn running direction is followed by a traversing installation 13, a contact roller 14, and a winding spindle 16.1, the yarn 19 being capable of being wound on the circumference of the latter so as to form a package 15. The take-up winding installation 12 in this exemplary embodiment supports a second winding spindle 16.2 which is held on a winding turret 17 such that the yarn 19, in an alternating manner on the two winding spindles 16.1 or 16.2, is capable of being continuously wound so as to form a package.

In the case of the embodiment of the device device according to the invention for carrying out the method according to the invention that is illustrated in FIG. 1, a polyamide melt, for example a PA6, is supplied to the spinning installation 1 and by means of the spinning nozzle 1.4 extruded so as to form a multiplicity of filaments. The filaments after cooling by a cooling airflow are assembled to form a yarn, without a fluid being supplied. The yarn 19 is subsequently entangled by an airflow, however without forming interlocking knots.

In order for the filaments 18 and the yarn 19 to be drawn off, the first non-heated guide casing 4.1 is driven at a circumferential speed in the range from 3400 m/min to 4600 m/min, preferably from 4000 m/min to 4400 m/min. The subsequent guide casings 4.2 and 4.3 of the first godet group 4 are driven at identical circumferential speeds or at slightly increasing circumferential speeds. The circumferential speed differential herein is 20 to 100 m/min. Stable yarn guidance during drawing-off of the yarn can thus be implemented.

In order for the yarn 19 to be drawn in the drafting zone 8.1, the guide casings 5.1 to 5.4 of the second godet group 5 by way of the heating means 6.1 to 6.4 are heated to a surface temperature in the range from 140° C. to 200° C. The surface temperatures of the guide casings 5.1 to 5.4 are preferably adjusted to a uniform temperature level. The guide casings 5.1 to 5.4 in relation to the guide casing 4.3 are driven at a higher circumferential speed such that the yarn is drawn. The circumferential speed of the guide casings 5.1 to 5.4 herein is in the range from 4400 m/min to 5400 m/min. The yarn after drafting is heated under tension on the surfaces of the guide casings 5.1 to 5.4 and relaxed. The yarn 19 is subsequently directed in a non-contacting manner through the cooling section 8.2 and received by the non-heated guide casing 7.1 of the third godet group 7. The guide casing 7.1 herein is driven at a circumferential speed that in relation to the guide casing 5.4 disposed upstream is substantially identical. The yarn material can thus be cooled such that the internal structure of the molecular chains in the yarn material is sufficiently stabilized. First friction contact takes place only after cooling of the yarn, in the yarn piece between the guide casings 7.1 and 7.2.

The yarn in the yarn piece between the guide casings 7.1 and 7.2 is initially wetted with a preparation fluid and is subsequently entangled by an airflow. Intensive cohesion of the filaments 18 within the yarn 19 is thus formed. At the end of the process, the yarn 19 is wound so as to form the package 15, wherein the yarn 19 is guided with low friction over the deflection roller 11 between the third godet group 7 and the winding position 12. The take-up winding speed of the winding spindles 16.1 and 16.2 is preferably adjusted so as to be somewhat lower than the circumferential speed on the guide casing 7.2. The tension variations that are caused by the displacement of the yarn by means of the traversing installation 13 can thus be advantageously equalized.

In order for the influence of the invention to be made visible, a yarn from PA6 having a total yarn count of 80 den and a filament count of 48 was produced by means of the device illustrated in FIG. 1. The drawing-off speed of the first godet group was adjusted to 4300 m/min. The surface temperatures of the guide casings 5.1 to 5.4 of the second godet group 5 was 190° C. The yarn was subsequently guided with and without cooling. In the case of the version without cooling, the preparation installation 9 was disposed in the yarn piece in the cooling section 8.2 between the guide casing 5.4 of the second godet group 5 and the first guide casing 7.1 of the third godet group 7. Subsequently, boil water shrinkage, strength, and residual elongation were measured. The so-called quality number was determined from the strength and the residual elongation. The quality index QN is derived from the following formula:

$$QN=F^2\sqrt{R}$$

Herein, F equals the strength in cN/dtex, and R=the residual elongation in %.

The absolute values of boil water shrinkage in % and the dimensionless values of the quality index QN are entered in a diagram in FIG. 2. Boil water shrinkage is referred to by the acronym BWS. The values of the yarn PA80f48 are illustrated in the left half of the diagram, the yarn not having run through any cooling section in the latter. Those values that were achievable by cooling the yarn are entered in the right half of the diagram. It is remarkable that the boil water shrinkage, having the BWS values 9.81% and 10% has remained almost constant. By contrast, the quality index QN has clearly increased from 31.7 to 37.4. This increase in the quality index by 18% is based solely on the yarn after relaxing having received sufficient cooling. To this extent, the method according to the invention is particularly suitable for producing yarns from polyamide that have low shrinkage and high strength.

A further exemplary embodiment of a device according to the invention for carrying out the method according to the invention is shown in FIG. 3. The example according to the invention as per FIG. 3 is substantially identical to the exemplary embodiment as per FIG. 1, such that only points of differentiation will be explained at this stage, reference otherwise being made to the afore-mentioned description.

In the case of the embodiment of the device according to the invention that is illustrated in FIG. 3, the assembly yarn guide 2 is assigned a wetting installation 20 which for assembling the yarns carries out slight wetting of the filaments. Conventional preparation agent or else oils having a low water content can be used herein.

Furthermore, the third godet group 7 is formed from a total of three non-heated guide casings 7.1, 7.2, and 7.3. The guide casings 7.1 to 7.3 each are embodied so as to be drivable. A preparation installation 9 is disposed in the yarn path between the guide casings 7.1 and 7.2, and an entanglement installation 10 is disposed in the yarn path between the guide casings 7.2 and 7.3. To this extent, the post-treatments by preparing and entangling can be carried out in dissimilar yarn portions between the guide casings 7.1 to 7.3. This enables an additional degree of freedom, in particular when adjusting the entanglement of the yarns.

The function of the exemplary embodiment of the device according to the invention that is illustrated in FIG. 3 is identical to that of the exemplary embodiment as per FIG. 1, such that no further explanation pertaining thereto is to follow.

The invention claimed is:

1. A method for producing a multifilament yarn from a polyamide melt, comprising:

assembling a plurality of freshly extruded filaments after cooling to form the yarn, drawing off the yarn by guiding the yarn through a first godet group having non-heated guide casings at a drawing-off speed in the range from 3600 m/min to 4600 m/min, drawing the yarn between the first godet group having the non-heated guide casings and a second godet group having heated guide casings, heating the yarn to a yarn temperature in the range from 140° C. to 200° C. and relaxing the yarn, both said heating and said relaxing being performed while the yarn is guided under tension on the guide casings of the second godet group, and after said relaxing, running the yarn in a non-contacting manner through at least one free cooling section between the second godet group and a third godet group having non-heated guide casings.

2. The method as claimed in claim 1, wherein the yarn on the guide casings of the first and second godet groups is guided in each case having a single wrapping in an angular range from 100° to 270°.

3. The method as claimed in claim 2, wherein the yarn is guided on a total of three guide casings of the first godet group at increasing circumferential speeds at a speed difference in the range from 20 m/min to 100 m/min.

4. The method as claimed in claim 2, wherein the yarn is guided on a total of four guide casings of the second godet group at substantially identical circumferential speeds and identical surface temperatures.

5. The method as claimed in claim 2, wherein the yarn between a last guide casing of the second godet group and a first guide casing of the third godet group is guided at decreasing circumferential speeds at a speed difference in the range from 0 to 50 m/min.

6. The method as claimed in claim 1, wherein the filaments after cooling are assembled to form the yarn in a dry or slightly wetted state, and wherein the yarn in a sub-section between the guide casings of the third godet group is treated with a preparation fluid.

7. The method as claimed in claim 1, wherein the yarn is entangled after preparation in a sub-section between the guide casings of the third godet group.

8. The method as claimed in claim 1, wherein the yarn is wound to form a package at a take-up winding speed that is lower than a circumferential speed of a last guide casing of the third godet group.

9. A multifilament yarn production device, comprising:

a spinning installation, a cooling installation, and a plurality of godet groups including a first godet group having non-heated guide casings, a second godet group having heated guide casings, and a third godet group having non-heated guide casings, wherein the spinning installation is arranged upstream of the first godet group, the spinning installation being constructed and arranged to assemble a plurality of freshly extruded filaments after cooling to form the yarn, wherein the first godet group is followed by the second godet group, the first godet group being constructed and arranged to draw off the yarn at a drawing-off speed in the range from 3600 m/min to 4600 m/min, the first godet group and the second godet group being constructed and arranged to draw the yarn between the first godet group and the second godet group, the second godet group being constructed and arranged to heat the yarn to a yarn temperature in the range from 140° C. to 200° C. and to relax the yarn while the yarn is guided under tension on the guide casings of the second godet group, and wherein a non-contacting cooling section is configured between the second godet group and the third godet group, the second godet group and the third godet group being constructed and arranged to run the yarn in a non-contacting manner through the non-contacting cooling section.

10. The device as claimed in claim 9, wherein the guide casings of the first godet group and the second godet group are configured so as to be drivable in a counter-rotating manner and are mutually disposed in such a manner that the yarn on the circumference of the guide casings is guidable in each case having a single wrapping in an angular range from 100° to 270°.

11. The device as claimed in claim 10, wherein the first godet group is formed from three non-heated guide casings, and wherein at least two separately controllable drives are provided for driving the guide casings of the first godet group.

12. The device as claimed in claim 9, further comprising:

a preparation installation disposed in a yarn path between the guide casings of the third godet group.

13. The device as claimed in claim 12, further comprising:

an entanglement installation disposed in the yarn path between the guide casings of the third godet group.

14. The device as claimed in claim 9, further comprising:

a take-up winding installation disposed directly downstream of the third godet group, wherein a last guide casing of the third godet group is assigned a deflection roller of the take-up winding installation.

15. The method as claimed in claim 1, wherein drawing off the yarn by guiding the yarn through the first godet group having the non-heated guide casings at the drawing-off speed in the range from 3600 m/min to 4600 m/min includes:

drawing off the yarn at a drawing-off speed in the range from 4000 m/min to 4400 m/min.

16. The device as claimed in claim 9, wherein the first godet group is constructed and arranged to draw off the yarn at a drawing-off speed in the range from 4000 m/min to 4400 m/min.

* * * * *